US007856190B2

(12) United States Patent
Kishi

(10) Patent No.: US 7,856,190 B2
(45) Date of Patent: Dec. 21, 2010

(54) HEATING DEVICE, FIXING DEVICE, METHOD OF CONTROLLING TEMPERATURE OF HEATING MEMBER, AND IMAGE FORMING APPARATUS

(75) Inventor: Kazuhito Kishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 286 days.

(21) Appl. No.: 12/007,514

(22) Filed: Jan. 11, 2008

(65) Prior Publication Data

US 2008/0181642 A1 Jul. 31, 2008

(30) Foreign Application Priority Data

Jan. 31, 2007 (JP) ..... 2007-021954

(51) Int. Cl.
*G03G 15/20* (2006.01)

(52) U.S. Cl. ..... 399/67; 399/69; 399/70; 399/88

(58) Field of Classification Search ..... 399/67, 399/69, 70, 88
See application file for complete search history.

(56) References Cited

U.S. PATENT DOCUMENTS

| | | | | |
|---|---|---|---|---|
| 5,736,914 | A * | 4/1998 | Yamaguchi et al. | 335/284 |
| 6,246,843 | B1 | 6/2001 | Hideo et al. | |
| 6,542,705 | B2 | 4/2003 | Fujita et al. | |
| 6,545,255 | B2 * | 4/2003 | Sato et al. | 219/619 |
| 7,002,112 | B2 | 2/2006 | Kishi et al. | |
| 7,010,255 | B2 | 3/2006 | Yura et al. | |
| 7,054,570 | B2 | 5/2006 | Kishi et al. | |
| 7,116,923 | B2 | 10/2006 | Kishi et al. | |
| 7,130,555 | B2 | 10/2006 | Kishi et al. | |
| 7,196,286 | B2 | 3/2007 | Kishi et al. | |
| 7,209,675 | B2 | 4/2007 | Matsusaka et al. | |
| 7,212,758 | B2 | 5/2007 | Kishi et al. | |
| 7,212,759 | B2 | 5/2007 | Kishi et al. | |
| 7,239,821 | B2 | 7/2007 | Matsusaka et al. | |

(Continued)

FOREIGN PATENT DOCUMENTS

| | | |
|---|---|---|
| JP | 04-044075 | 2/1992 |

(Continued)

OTHER PUBLICATIONS

European Patent Office Search Report dated Jun. 11, 2008, for corresponding European Patent Application No. 08250202.2-2209.

*Primary Examiner*—David P Porta
*Assistant Examiner*—Casey Bryant
(74) *Attorney, Agent, or Firm*—Harness, Dickey & Pierce, P.L.C.

(57) ABSTRACT

A heating device heats, by electromagnetic induction heating, a heating member disposed in a fixing device for use in an image forming apparatus. The fixing device heats and fixes an image on a recording material while nipping and transporting the recording material. The heating device includes an exciting coil that is disposed along the heating member and generates an alternating magnetic flux to heat the heating member by electromagnetic induction heating, a demagnetizing coil that encircles part of the alternating magnetic flux generated by the exciting coil and generates an electro motive force in a direction that cancels the alternating magnetic flux, and a demagnetizing regulator that is provided in a demagnetizing circuit including the demagnetizing coil and adjusts a current to be generated in the demagnetizing coil.

12 Claims, 15 Drawing Sheets

U.S. PATENT DOCUMENTS

| | | | | |
|---|---|---|---|---|
| 7,247,816 | B2 | 7/2007 | Kishi et al. | |
| 2005/0067408 | A1* | 3/2005 | Fujii et al. | 219/619 |
| 2005/0123315 | A1 | 6/2005 | Kishi et al. | |
| 2005/0139584 | A1 | 6/2005 | Kishi et al. | |
| 2005/0191078 | A1 | 9/2005 | Kishi et al. | |
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1 | 6/2006 | Kishi et al. | |
| 2006/0237446 | A1 | 10/2006 | Kishi et al. | |
| 2007/0031159 | A1 | 2/2007 | Kishi et al. | |
| 2007/0071479 | A1 | 3/2007 | Semma et al. | |
| 2007/0098433 | A1 | 5/2007 | Yano et al. | |
| 2007/0116484 | A1 | 5/2007 | Kishi et al. | |
| 2007/0183806 | A1 | 8/2007 | Kishi et al. | |
| 2007/0200432 | A1 | 8/2007 | Yano et al. | |
| 2007/0212090 | A1 | 9/2007 | Matsusaka et al. | |
| 2009/0067867 | A1* | 3/2009 | Yamashita et al. | 399/67 |
| 2009/0297197 | A1* | 12/2009 | Hase | 399/69 |

FOREIGN PATENT DOCUMENTS

| | | |
|---|---|---|
| JP | 2000-214702 | 8/2000 |
| JP | 2001-060490 | 3/2001 |
| JP | 2001-135470 | 5/2001 |
| JP | 2005-108603 | 4/2005 |
| JP | 2005-321642 A | 11/2005 |
| JP | 2008-040176 A | 2/2008 |

* cited by examiner

HEATING DEVICE, FIXING DEVICE, METHOD OF CONTROLLING TEMPERATURE OF HEATING MEMBER, AND IMAGE FORMING APPARATUS

BACKGROUND OF THE INVENTION

1. Field of the Invention

The present invention relates to a heating device and a fixing device, both for use in an image forming apparatus; a method of controlling temperature of a heating member; and an image forming apparatus.

2. Description of the Related Art

Copy machines, printers, and facsimile machines form images on recording media such as plain paper and OHP sheets. There are various systems for forming images on recording media. An electrophotographic system is one of those systems and is widely used due to high-speed performance, high image quality and low cost. An image forming apparatus, such as a printer and a facsimile machine, using the electrophotographic system includes a transfer unit. The transfer unit forms a latent image according to image information such as electronic information or optical information, develops the latent image with toner (image developing agent) made of thermoplastic resin containing pigment, and transfers the developed image onto a recording material by using a direct or indirect (transfer) system to form a toner image thereon. A fixing device is used to permanently fix the toner image transferred on the recording material by heat. A heating roller system is currently most widely used in such a fixing device because of its high speed and safety performance.

The heating roller system includes a heating roller (also called as a fixing roller) heated by the heat source and a pressure roller opposing the heating roller, together forming a nip portion therebetween. A sheet of a recording material is passed through the nip portion so that toner on the sheet is fixed thereon by heat. A typical heating roller system uses a halogen lamp as the heat source. The halogen lamp is disposed inside the fixing roller so as to heat the fixing roller from its inside to increase the surface temperature of the fixing roller to an appropriate temperature. Problems with such a heating roller system using the halogen lamp are that reduction of the heat capacity (thickness) of the fixing roller is limited and that the start-up is slow due to slow start up of the halogen heater.

To solve these problems, a belt heating system has been developed. The belt heating system uses an endless sheet-like belt as a heating belt in place of the heating roller. The heating belt and a pressure roller form a pressure-contact portion (a nip portion) therebetween. A sheet of recording material is passed through the nip portion so that an unfixed toner image on the recording material is fixed thereon by heat. The heating belt moves over a heating body (usually serving also as support rollers). The heating belt is heated by the heating body so as to heat and fix the toner image on the recording material. A heating device using the belt heating system can use a ceramic heater or the like having a low heat capacity as a heating body, and can use a thin heat-resistant sheet having a low heat capacity as a belt member of the heating belt. Therefore, compared with a heating device of a heating roller system that uses a heating roller having a high heat capacity, the heating device of the belt heating system uses less power and achieves shorter waiting time, and thus can provide advantages such as quick starting (see Japanese Patent Laid-Open Publication No. H04-44075 (Patent Document 1)).

However, in the sheet-like heating belt having the reduced heat capacity, the heat flow in the width direction of the heating belt (the direction perpendicular to the belt moving direction, i.e., the longitudinal direction of the nip portion) is blocked. Accordingly, when a small size recording sheet is passed over in contact with only a part of the heating belt in the width direction of the heating belt, a non-sheet-passing portion of the heating belt is overheated, resulting in reducing the service lives of the heating belt and the pressure roller. One way to solve this problem is to increase the interval of feeding the recording sheets when feeding small size recording sheets and thus lower the throughput of passing the sheets, thereby allowing heat transfer in the heating belt and providing cooling time. However, providing time for the heating belt to reach uniform temperature significantly lowers the image forming speed of the image forming apparatus. This problem applies more or less to the above-described heating roller system as well.

In recent years, use of an electromagnetic induction heating system has been studied as a way of heating the fixing roller. This system includes a magnetic flux generating unit that generates an alternating magnetic flux, which produces an eddy current to cause electromagnetic induction heating of a fixing roller having a conductive layer. This electromagnetic induction heating system can directly heat the target, the surface layer of the fixing roller, and therefore can heat the fixing roller more quickly compared to the halogen heater and can reduce the waiting time for starting operations. Further, the speed of supplying heat is high enough to enable high-speed operation of the image forming apparatus.

Japanese Patent Laid-Open Publication No. 2000-214702 (Patent Document 2) discloses a fixing roller of an electromagnetic induction heating system. The fixing roller includes five layers, a support layer (core layer), a sponge layer (foamed layer), an electromagnetic induction heat generating layer, an elastic layer, and a releasing layer in this order from inside to outside. The heat generated by the heat generating layer is blocked by the sponge layer, so that the elastic layer and the releasing layer at the surface of the fixing roller can be quickly heated. With this configuration, the surface of the fixing layer is quickly heated to a required temperature and, after heat is transferred to a recording medium such as paper, the fixing roller is quickly reheated. This permits higher speed operation than that using a halogen lamp.

A problem with the electromagnetic induction heating system is that, because the electromagnetic induction heat generating layer is thin, it is difficult to control the temperature distribution in the longitudinal direction of the fixing roller as in the case of the belt heating system. In some fixing devices, when continuously fixing images on small size media, a part of or the entire fixing roller is overheated. A typical image forming apparatus is capable of forming images on several types of recording media of different widths. The term "recording media of different widths" indicates various standard size recording media of JIS A and B sizes and non-standard size recording media. Even in the case of recording media having the same size (e.g. A4 size), if one is fed in the portrait orientation and the other in the landscape direction, they are handled as recording media of different widths. When a fixing device fixes images on recording media of different widths, the heat distribution in the fixing member in the width direction varies due to the different widths of the recording media, resulting in a temperature variation. For example, in the case of fixing an image on a small width recording medium, a region (a sheet-passing-region) corresponding to the width of the recording medium loses more heat and has lower fixing temperature than a region (non-sheet-passing region) on which the recording medium does not pass. This phenomenon becomes especially pronounced when small width recording media are continuously passed over.

If the fixing temperature of the fixing roller across the entire width thereof is controlled based on the fixing temperature of the horizontal center portion of the fixing roller as a reference temperature, which center portion is always in the sheet-passing-region, although the fixing temperature of the horizontal center portion of the fixing roller can be maintained constant, the fixing temperatures of the opposite horizontal end portions of the fixing roller are (excessively) increased. If a large-width recording medium goes through a fixing process using the fixing roller whose opposite lateral end portions have increased fixing temperatures, hot offset is produced in portions of the recording medium corresponding to the portions of the fixing roller having increased temperatures. Moreover, if the fixing temperatures of the opposite lateral end portions exceed the allowable temperature limit of the fixing roller, the fixing roller can be damaged due to heat. On the other hand, if the fixing temperature of the fixing roller across the entire width thereof is controlled based on the fixing temperatures of the opposite horizontal end portions of the fixing roller as a reference temperature, although the fixing temperatures of the opposite horizontal end portions of the fixing roller are controlled to the desired temperature, the fixing temperature of the horizontal center portion of the fixing roller decreases. If a recording medium goes through a fixing process using the fixing roller whose lateral center portion has a reduced fixing temperature, cold offset is produced in the portion of the recording medium corresponding to the portion of the fixing roller having the reduced temperature.

To solve these problems, a halogen heater type fixing device uses plural heaters as the heat source. The heaters are disposed to emit lights on the center portion and end portions of the fixing roller and are individually controlled so as to control the temperature of the fixing roller. However, in the case of the electromagnetic induction heating system that heats a target by a magnetic flux generated by a coil, providing separate coils for heating the center portion and the end portions as in the case of the halogen heaters is not a practical solution because many problems arise such as cost increase and interference between the coils.

Another solution may be to provide, in addition to an exciting coil for electromagnetic induction heating, a secondary demagnetizing coil in a region corresponding to a non-sheet-passing region. The secondary demagnetizing coil generates an inductive motive force and an inductive current due to fluctuation of magnetic flux of the exciting coil, so that the inductive motive force and the inductive current reduce the magnetic flux in the non-sheet-passing region, thereby preventing overheating. When reducing heat generation, the secondary demagnetizing coil is closed by a switching circuit, such as a relay, a FET, or an IGBT, so as to generate a current. When not reducing heat generation, the secondary demagnetizing coil is opened so as not to activate the secondary demagnetizing coil, thereby preventing generation of a demagnetizing magnetic flux. Heat generation is thus controlled by opening and closing the switch.

For instance, Japanese Patent Laid-Open Publication No. 2001-60490 (Patent Document 3) and Japanese Patent Laid-Open Publication No. 2001-135470 (Patent Document 4) disclose heating rollers as described below. A heating roller includes therein a magnetic core comprising three pieces and extending in the width direction of the sheet; an exciting coil disposed around the magnetic core and wound to form a layer on the inner surface of the heating roller; and demagnetizing coils (cancel coils) wound around the outer pieces of the magnetic core and extending in the direction perpendicular to the layer of the exciting coil. When fixing an image on a sheet of recording material of the maximum width, the demagnetizing coils are opened by a switching circuit so as not to be activated. Therefore, the image is appropriately fixed across the entire width of the sheet of the maximum width. When fixing an image on a smaller width sheet, the demagnetizing coils are closed by the switching circuit. Accordingly, at the end portions of the heating roller in the sheet width direction, not only an inductive current (eddy current) due to fluctuation of the magnetic flux of the exciting coil, but also a back electromotive force (and a current induced by the force) are generated. Thus, temperature rise is reduced at the end portions of the heating roller.

Japanese Patent Laid-Open Publication No. 2005-108603 (Patent Document 5) discloses a fixing device that has a different coil arrangement from that of the above-described fixing device. In the fixing device of Patent Document 5, a demagnetizing coil is disposed along the layer of an exciting coil. With this arrangement, the demagnetizing coil can effectively cancel the magnetic flux of the exciting coil, and thus demonstrate the increased effect of reducing temperature rise.

As described above, the electromagnetic induction heating system, which has many advantages including reduced power consumption and quick start, can deal with a variation of widths of recording sheets to some extent. However, because the temperature control using the secondary demagnetizing coil as described above relies on the On/Off control of the secondary demagnetizing coil (hereinafter referred to also as a demagnetizing coil), it is difficult to provide precise temperature control. For example, in the case of the fixing rollers disclosed in Patent Documents 3 and 4, because the greater part of each demagnetizing coil, which extends in the direction perpendicular to the layer of the exciting coil, excluding an end portion of the demagnetizing coil facing the exciting coil is spaced apart from the exciting coil, leakage magnetic flux (magnetic flux of the exciting coil not passing through the magnetic core) does not pass through the demagnetizing coil. Therefore, the demagnetizing coil has less effect of reducing temperature rise, resulting in an insufficient temperature reduction of the heating roller. In the case of the fixing device disclosed in Patent Document 5, because the demagnetizing coil is disposed to face a heating roller with the exciting coil therebetween, a leakage magnetic flux (magnetic flux of the exciting coil not passing through a magnetic core (a holder)) does not pass through the demagnetizing coil. Therefore, the demagnetizing coil has less effect of reducing temperature rise, resulting in an insufficient temperature reduction of the heating roller.

As mentioned above, since there is a gap between the exciting coil and the demagnetizing coil due to the arrangement thereof, leakage of magnetic flux is inevitable. To enhance the demagnetizing effect, the number of turns of the demagnetizing coil may be increased. However, increasing the number of turns of the demagnetizing coil increases the entire size of the heating device. If the magnetic core is disposed on the path of the exciting coil and the demagnetizing coil for increasing their connection, or if the size of the demagnetizing coil is increased, the current applied to the demagnetizing coil may become too high depending on the condition of supplying power to the exciting coil. If the current value of the demagnetizing coil becomes excessively high, the current may exceed the allowable current of a switching element that controls opening and closing of the circuit. Further, the temperature of the demagnetizing coil may exceed the allowable temperature limit of the wires thereof. If a high current is unexpectedly applied to the demagnetizing coil, the effect of reducing heat generation may be excessively increased, so that the temperature of the non-sheet-passing portion may be excessively reduced.

SUMMARY OF THE INVENTION

In view of the foregoing, the present invention is directed to provide a heating device that has advantages of an electromagnetic induction heating system and is capable of precisely adjusting the temperature of a heating member such as a roller without a risk of overcurrent in a magnetizing circuit; a fixing device having the heating device; and a method of controlling the temperature of the heating member. The present invention is also directed to provide an image forming apparatus having the fixing device.

The inventor of the present invention has found that, in a fixing device of an electromagnetic induction heating system for use in an image forming apparatus, in which the fixing device heats and fixes an image on a sheet of recording material, a heating device can precisely adjust the temperature of a heating member such as a heating roller by having a demagnetizing current regulator that regulates the current to be generated in a demagnetizing coil in a demagnetizing circuit.

According to an aspect of the present invention, there is provided a heating device that heats, by electromagnetic induction heating, a heating member disposed in a fixing device for use in an image forming apparatus, the fixing device heating and fixing an image on a sheet of recording material while nipping and transporting the recording material. The heating device comprises an exciting coil that is disposed along the heating member and generates an alternating magnetic flux to heat the heating member by electromagnetic induction heating; a demagnetizing coil that encircles part of the alternating magnetic flux generated by the exciting coil and generates an electro motive force in a direction that cancels the alternating magnetic flux; and a demagnetizing regulator that is provided in a demagnetizing circuit including the demagnetizing coil and adjusts a current to be generated in the demagnetizing coil.

According to another aspect of the present invention, there is provided a fixing device adapted for use in an image forming apparatus and configured to heat and fix an image on a sheet of recording material while nipping and transporting the recording material with use of a heating member and a pressure member. The fixing device comprises the above-described heating device that heats the heating member by electromagnetic induction heating.

According to still another aspect of the present invention, there is provided a method of controlling a temperature of a heating member that is to be heated by an electromagnetic induction heating system and is disposed in a fixing device for use in an image forming apparatus, in which the fixing device heats and fixes an image on a sheet of recording material while nipping and transporting the recording material, wherein an exciting coil disposed along the heating member generates an alternating magnetic flux to heat the heating member by electromagnetic induction heating, and wherein a demagnetizing circuit including a demagnetizing coil, which encircles part of the alternating magnetic flux generated by the exciting coil, generates an electro motive force in a direction that cancels the alternating magnetic flux. The method includes a step of adjusting a current to be generated in the demagnetizing coil by using a demagnetizing current regulator provided in the demagnetizing circuit when the demagnetizing circuit including the demagnetizing coil generates the electro motive force.

According to further another aspect of the present invention, there is provided an image forming apparatus capable of forming images on recording materials of different widths, the image forming apparatus including the above-described fixing device.

Embodiments of the present invention can provide a heating device that has advantages of an electromagnetic induction heating system and is capable of precisely adjusting the temperature of a heating member such as a roller without a risk of overcurrent; a fixing device having the heating device; a method of controlling the temperature of the heating member; and an image forming apparatus having the fixing device.

DETAILED DESCRIPTION OF THE PREFERRED EMBODIMENT (Heating Device)

Figure 1:
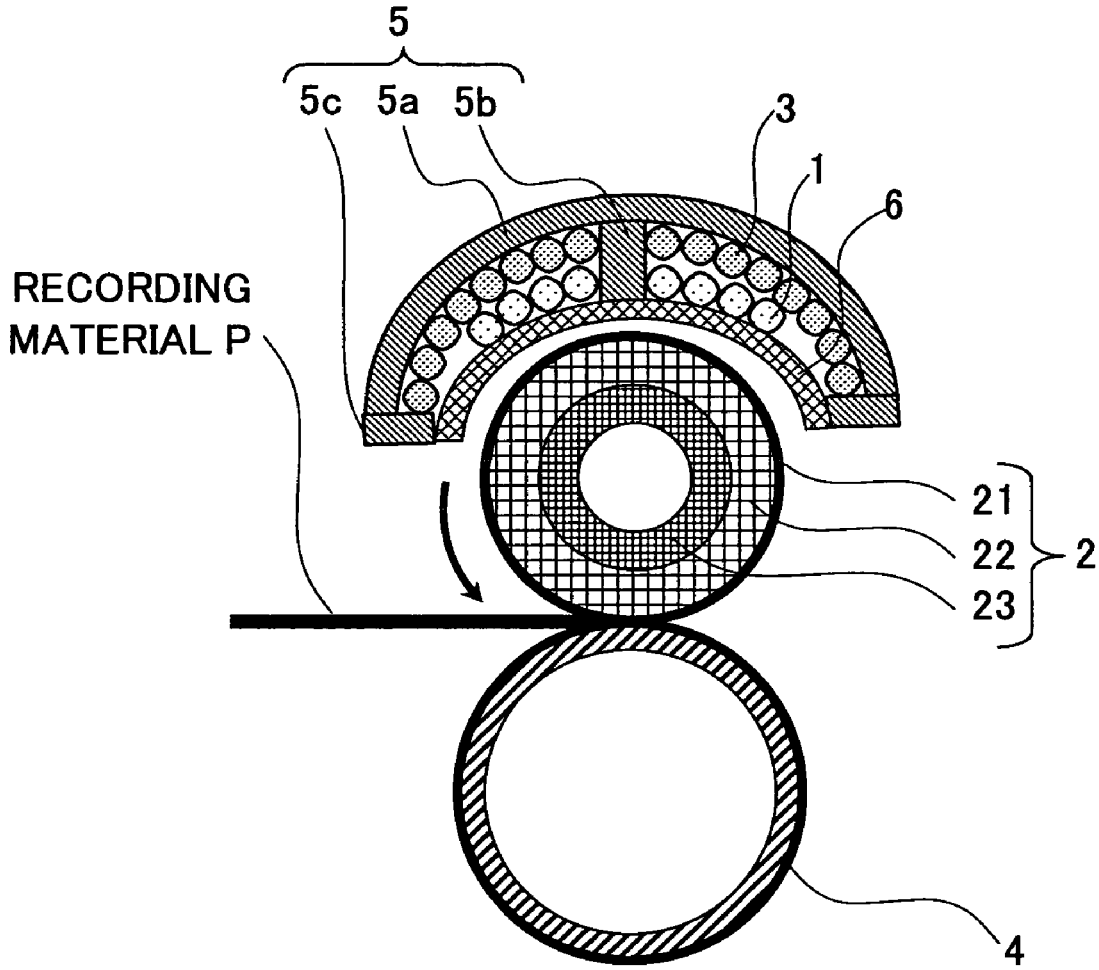
FIG. 1 is a cut-away side view showing a fixing device according to an embodiment of the present invention.
Figure 2:
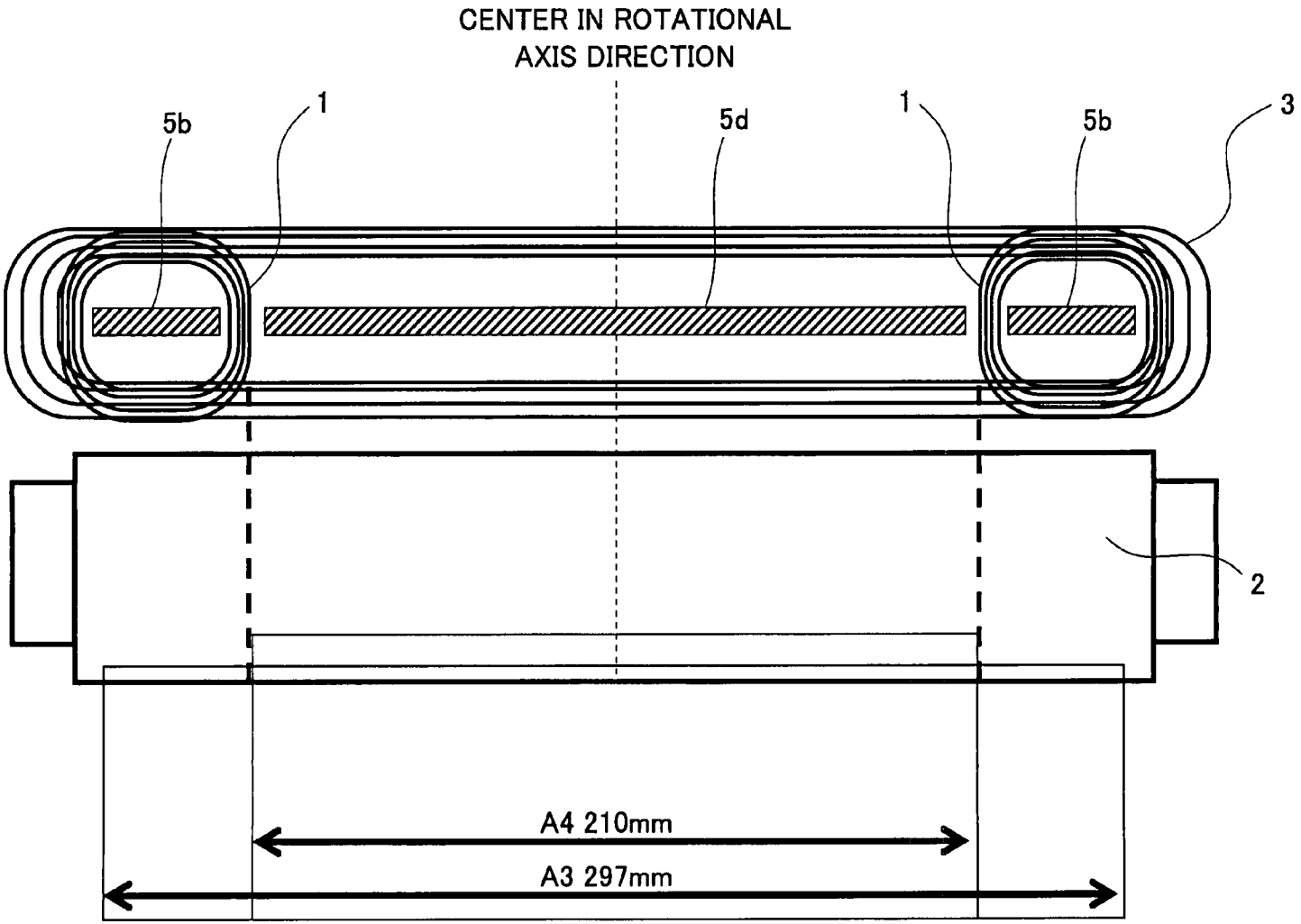
FIG. 2 is a diagram showing an arrangement of coils of a heating device according to an embodiment of the present invention.

An exemplary heating device is described with reference to FIGS. 1 and 2 according to an embodiment of the present invention. FIG. 1 is a cross-sectional view showing a fixing device equipped with a heating device of an electromagnetic induction heating system at a plane orthogonal to a longitudinal axis of a fixing roller 2 (hereinafter also referred to as a heating roller). FIG. 2 is a view diagram used to describe the arrangement of coils 1 and 3 with respect to the heating roller 2 of the heating device as viewed from the top of FIG. 1 according to an embodiment of the present invention. In FIG. 2, magnetic cores 5*b* and 5*d* of a magnetic core 5 arranged inside an exciting coil 3 are shown, but magnetic cores 5*a* and 5*c* of the magnetic core 5 are not shown for the sake of simplicity. Also, the heating roller 2 is actually disposed under the coils and should be shown overlaid with the coils 1 and 3, but is shown under the coils 1 and 3 for clarity. FIG. 1 is the cross-sectional view at the plane close to the end of the heating roller 2 where the magnetic core 5*b* is present.

Referring to FIG. 1, the fixing device includes the heating roller 2 as a heating member, a pressure roller 4 forming a nip region together with the heating roller 2, the exciting coil 3 as a magnetic field producing unit that produces a magnetic field with an alternating current applied thereto, the magnetic core 5 that prevents the magnetic field produced by the exciting coil 3 from leaking outside, and the demagnetizing coils 1 on a path of the magnetic flux produced by the exciting coil 3.

In this embodiment, the heating roller 2 has an outside diameter of 40 mm and a length of 320 mm, and is capable of fixing an image on a sheet of a maximum of A3 size. The magnetic field produced by the exciting coil 3 inductively heats a heat generating layer 21, the surface layer, of the heating roller 2. A sheet of recording material P is passed through the nip region formed between the heating roller 2 and the pressure roller 4 so that toner on the recording material P is fixed thereon by heat of the heating roller 2 and pressure. In the case of heating and fixing toner on a sheet of a width less than the width of the heating roller 2, e.g., an A4 size sheet, the sheet comes into contact with the center portion of the heating roller 2, which is indicated by the arrows of FIG. 2 denoted by A4.

The exciting coil 3 is a bundle of 90 surface-insulated copper wires having 0.15 mm outer diameters. The exciting coil 3 is wound 10 turns and disposed along the heating roller 2 so as to extend in the direction of the rotational axis of the heating roller 2 as shown in FIG. 2. Although not shown, the exciting coil 3 is connected to a power source that supplies alternating current to produce a magnetic field. As can be seen from FIG. 2, the exciting coil 3 includes straight portions parallel to the rotational axis of the heating roller 2 and curved portions, each curved in the shape of an arch, one near each end of the heating roller 2. Because the intensities of the magnetic fields produced by the straight portions are different from the intensities of the magnetic fields produced by the curved portions, the lengths of the straight portions of the exciting coil 3 are made substantially equal to or slightly greater than the length of the heating roller 2 so as to reduce the influence of the curved portions. This configuration makes the heating roller 2 generate heat uniformly in the rotational axis direction of the heating roller 2.

The demagnetizing coils 1 are made of the same bundle of copper wires as the exciting coil 3 and are disposed one facing each end of the heating rollers 2. In this embodiment, each demagnetizing coil 1 extends, along the exciting coil 3, outwardly from a position about 105 mm spaced apart from the center of the heating roller 2 in the axial direction and is wound around the corresponding magnetic core 5*b*. With this arrangement, the demagnetizing coils 1 can efficiently demagnetize non-sheet-passing regions at the end portions of the heating roller 2 when heating and fixing toner on an A4 size sheet as described below in greater detail. Each demagnetizing coil 1 is wound 6 turns, which is less than the exciting coil 3, is disposed along the surface of the heating roller 2. Similar to the exciting coil 3, the demagnetizing coils 1 are disposed to face the heat generating layer 21. The demagnetizing coils 1 are disposed inside the turns of the exciting coil 3 and at the heating-roller-2-side of the exciting coil 3 in order to reduce the overall size of the heating device. The demagnetizing coils 1 may be disposed between the exciting coil 3 and the heat generating layer 21 or between the exciting coil 3 and the magnetic core 5*a*. To enhance demagnetizing performance, it is preferable to dispose the demagnetizing coils 1 between the exciting coil 3 and the heating roller 2.

Referring back to FIG. 1, the magnetic core 5 includes the first magnetic core 5*a* disposed at the outer side of the exciting coil 3 and extending along the surface of the heat generating layer 21 across about half the diameter thereof; the second magnetic cores 5*b* extending from the first magnetic core 5*a* toward the centers of the corresponding demagnetizing coils 1; the third magnetic core 5*d* extending inside the exciting coil 3 but not inside the demagnetizing coils 1; and the fourth magnetic core 5*c* extending along the edge of the first magnetic core 5*a* so as to surround the exciting coil 3. The magnetic cores 5*a*, 5*b*, 5*c*, and 5*d* are provided to make the magnetic flux efficiently reach the heat generating layer 21 and are preferably made of a ferromagnetic material having high electric resistance such as, e.g., ferrite and permalloy. Although not clearly shown in FIG. 1, the magnetic core 5*a* may be a curved plate or a grid of curved bars.

Figure 3:
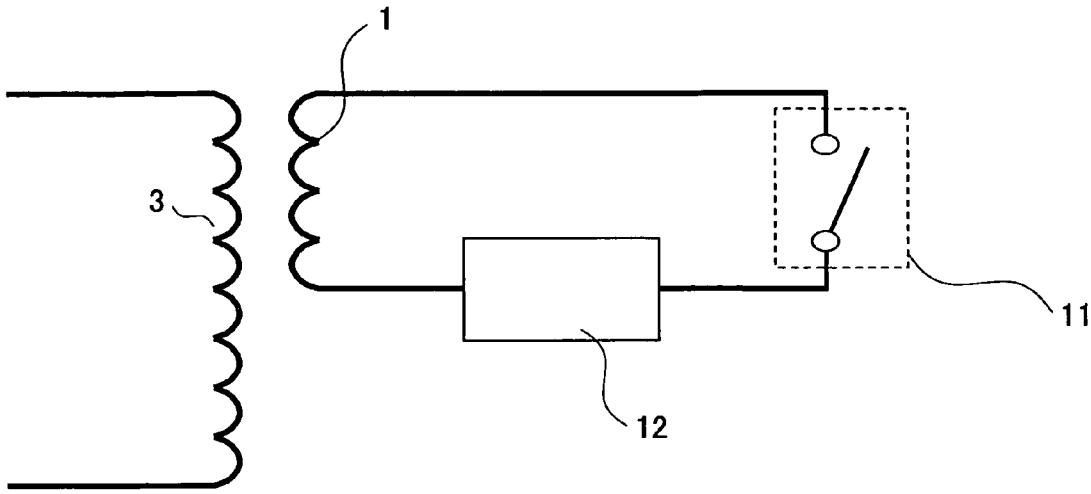
FIG. 3 is a diagram showing a demagnetizing circuit.

FIG. 3 shows a demagnetizing circuit that opens and closes the demagnetizing coil 1. The demagnetizing circuit includes the demagnetizing coil 1, a switch 11, and a demagnetizing current regulator 12. Although the switch 11 uses a mechanical relay in this embodiment, a triac, a FET, an IGBT or the like may alternatively be used. The switch 11 may have any configuration that can open and close the demagnetizing coil 1, such as one having a magnetoresistance effect element that has a varying electric resistance in accordance with fluctuation of the external magnetic field so as to apply magnetism at a desired timing or so as to vary the current applied to the demagnetizing coil 1 by a magnetic field of the exciting coil 3. The demagnetizing current regulator 12 adjusts the magnitude of the demagnetizing current generated by an electro motive force of the exciting coil 3, the waveform of the phase of the alternating current, and the resonant behavior of the exciting coil 3 with the alternating current in the demagnetizing circuit. The demagnetizing current regulator 12 may include at least one of a resistive element, a capacitor, an inductor, and a diode element, or may include plural of these elements. Further, a variable resistance element and an impedance variable capacitor may appropriately be used.

The heating roller 2 as a heating member is described with reference to FIG. 1. In this embodiment, the heating roller 2 has a length of 320 mm in the rotational axis direction and a diameter of 40 mm, and includes a releasing layer formed on the surface of a heat generating member, the electrically-conductive heat generating layer 21 as a main body of the heat generating member, an elastic layer 22, and a core layer 23. The positional relationship of these layers is shown in FIG. 1, wherein the releasing layer, the heat generating layer 21, the elastic layer 22, and the core layer 23 are stacked in this order, which is different from that of the heating roller of the halogen lamp type. In FIG. 1, the releasing layer is shown integrated with the heat generating layer 21.

The heat generating layer 21 is made of a metal material with high electric conductivity and high heat conductivity that easily generates eddy currents due to an alternating magnetic field and is suitable for electromagnetic induction heating. Although metal materials commonly recognized as suitable for electromagnetic induction heating are those having high resistance, the heat generating layer 21 may also be made of a metal material having low resistance and high heat conductivity. This is because the substantial resistance of the heat generating layer 21 can be adjusted to a desired level by reducing the layer thickness of the metal material, which enables adjustment of the heat release value of the heat generating layer 21. In an experiment according to this embodiment, a heat generating layer 21 was used that includes a 50 μm thick nonmagnetic stainless layer plated with a 10 μm thick copper layer. The heat generating layer 21 may include a high electric conductive and high heat conductive layer made of other metal materials such as silver, aluminum, magnesium, and nickel, or other magnetic materials such as nickel, and magnetic stainless.

The releasing layer, which is shown integrated with the heat generating layer 21 in FIG. 1, is disposed on the surface of the heat generating layer 21 and defines the outermost layer of the heating roller 2. The releasing layer prevents toner on a sheet of recording material from adhering to the heating roller 2. The releasing layer may be made of fluororesins such as PTFE, PFA, and FEP; a combination of theses fluororesins; or heat resistant resin with one or more of these fluororesins dispersed therein. The thickness of the releasing layer may preferably be in the range of 5-50 μm (more preferably in the range of 10-30 μm). The releasing layer makes the recording material passing on the heating roller 2 and the toner on the recording material be easily released therefrom.

The elastic layer 22 may be made of an elastic material such as fluororubber, silicon rubber, or fluoro—silicon-rubber. The elastic layer 22 increases the width of the nip region and makes the recording material be easily released from the heating roller 2. Also, the sheet discharge direction can be controlled by adjusting the hardness of the elastic layer 22. The elastic layer 22 may be made of sponge rubber so as to prevent heat from transferring to the inner side of the heating roller 2, insulate and hold the heat generated by the heat generating layer 21, and quickly heat the surface layer of the heating roller 2, makes the heating roller 2 quickly reach the temperature required for the fixing, and quickly reheats the heating roller 2 after the heat is transferred to the recording material. In an experiment according this embodiment, an elastic layer 22 was used that is made of foamed silicon rubber having a 7 μm thickness.

The core layer 23 is a support for the entire heating roller 2, and may preferably be made of metal such as iron or aluminum so as to have sufficient rigidity against the load for forming the nip region. It is also preferable that the core layer 23 be made of a nonmagnetic material such as a nonmagnetic stainless and ceramic, or an insulating material so as not to adversely affect the induction heating. In this embodiment, SUS304 stainless steel having a 22 mm outer diameter and a 2.0 mm thickness is used, which makes it possible to focus the energy for induction heating into the heat generating layer 21 without any loss.

(Heating Operation of the Fixing Device)

A fixing device including a heating device of an embodiment of the present invention operates as described below. When a high-frequency alternating current in the range about 10 kHz-1 MHz is applied to the exciting coil 3, magnetic field lines are formed in the loop of the exciting coil 3 the direction of which the magnetic field lines is alternately switched between two opposing directions. Then, eddy current is generated in the heat generating layer 21. The eddy current generates Joule heat, which heats the surface of the heat generating layer 21. The heating roller 2 is rotated in the direction indicated by the arrow as shown in FIG. 1. At the same time, the pressure roller 4 is also rotated in contact with the heating roller 2 at the nip portion. A sheet of recording material P with an unfixed toner image is passed through the nip portion in pressure contact therewith and is transported toward the other side of the heating roller 2. In this step, the toner image on the recording material P is heated and fixed by the surface heat of the heat generating layer 21 of the heating roller 2, so that the toner image is fixed on the recording material P.

The heat generated in the heat generating layer 21 forming the surface portion of the heating roller 2 is insulated and held in the elastic layer 22, so that the temperature of the surface portion, which is thin, quickly increases. That is, the fixing device has substantially improved start-up properties. The start-up properties indicate how quickly the heating roller 2 reaches the temperature required for fixing the toner. The shorter the time taken to reach the required temperature, the more user-convenient the image forming apparatus becomes. In an experiment according to this embodiment, the fixing temperature required for startup was 170° C. and the time taken to start up when providing heating electric power of 1200 W was 10 seconds.

Figure 4A:
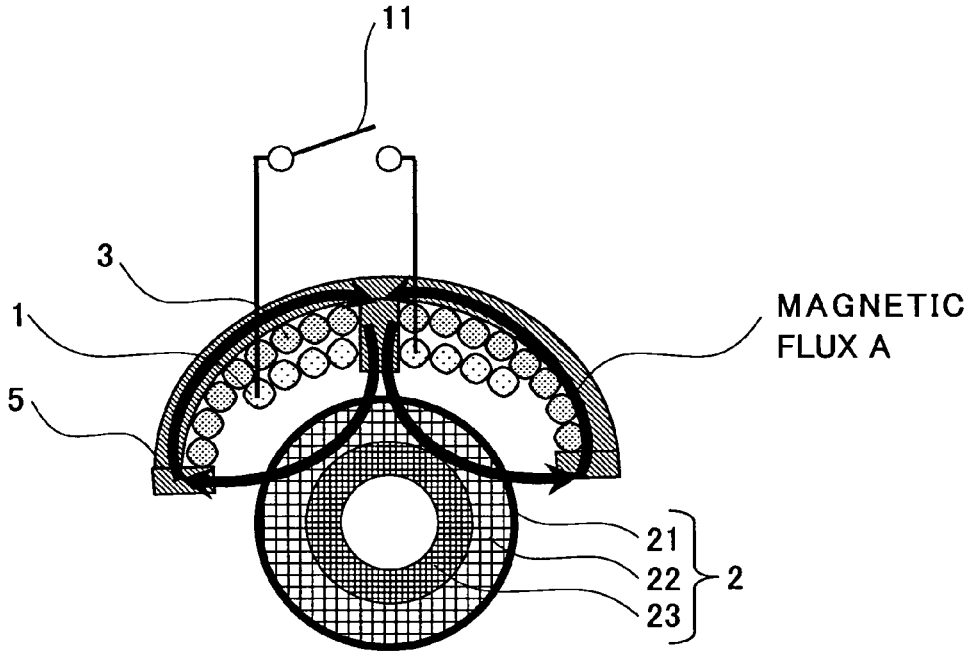
FIG. 4A is a diagram for explaining a heating principle wherein a switch is opened.
Figure 4B:
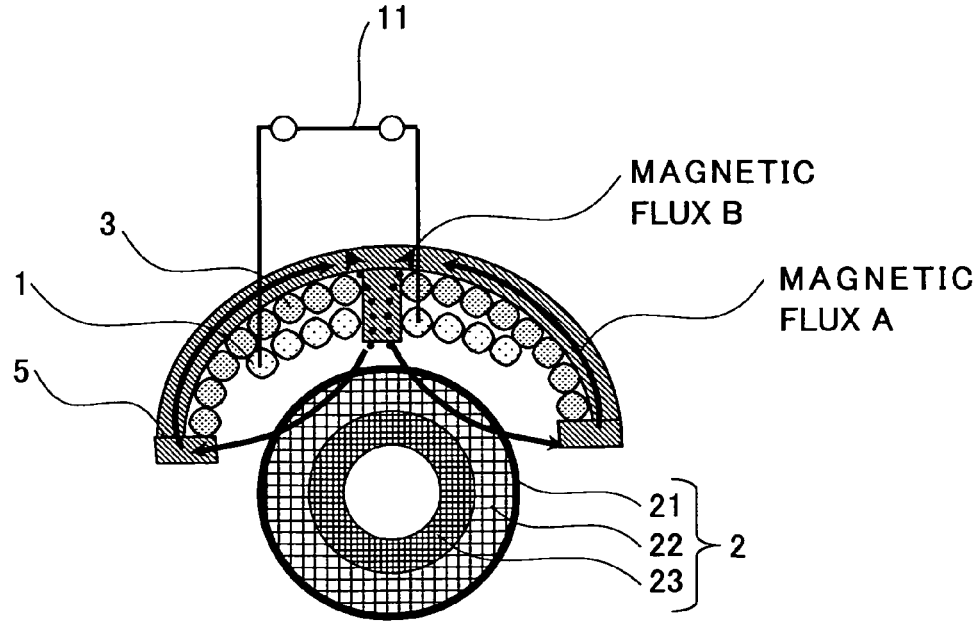
FIG. 4B is a diagram for explaining a heating principle wherein a switch is closed.

The mechanism that the demagnetizing coils 1 prevent overheating of a non-sheet-passing portion of the heating roller 2 is described below. FIGS. 4A and 4B are diagrams for explaining a principle of heating adjustment, wherein a portion related to induction heating is shown. In FIG. 4A, the arrows represent a magnetic flux A at the time the demagnetizing circuit including the demagnetizing coil 1 is opened, i.e., the switch 11 is opened. The magnetic flux A generated by the exciting coil 3 passes through the magnetic core 5 and the heat generating layer 21, and then returns to the magnetic core 5. In this step, the magnetic flux A forms a magnetic circuit that passes through the heat generating layer 21. Accordingly, induction current flows through the heat generating layer 21, so that the heat generating layer 21 generates heat due to Joule heating. Since the demagnetizing circuit including the demagnetizing coil 1 is electrically opened, although an electromotive force is generated, no current flows. Therefore, the magnetic flux A of the exciting coil 3 is not cancelled, so that heating is performed as in the portion not having the demagnetizing coil 1.

FIG. 4B shows the magnetic flux A at the time the demagnetizing coil 1 is short-circuited, i.e., the switch 11 is closed. The magnetic flux A generated by the exciting coil 3 is partly cancelled by a magnetic flux B generated by the demagnetizing coil 1, so that the density of the magnetic flux A is lowered. Most of the magnetic flux A generated by the exciting coil 3 passes through the demagnetizing coil 1, so that a back electromotive force is generated in the demagnetizing coil 1. Further, since the switch 11 is closed, a current flows through the demagnetizing coil 1. Thus, the magnetic flux B generated in the direction that cancels the magnetic flux A of the exciting coil 3 significantly weakens the magnetic flux that inductively heats the heat generating layer 21. Accordingly, a low inductive current corresponding to the magnetic flux flows through the portion of the heat generating layer 21 facing the demagnetizing coil 1, so that the heat generation by the heat generating layer 21 due to Joule heating is reduced. In this case, as described below in detail, the heat generation by the heat generating layer 21 due to Joule heating can be adjusted by the demagnetizing current regulator 12 in the demagnetizing circuit including the demagnetizing coil 3.

If a sheet of recording material of A3 size is passed through the fixing device, the demagnetizing coils 1 are not activated as shown in FIG. 4A. Thus, the heating roller 2 including the end portions thereof generates heat to handle heat transferred to the A3 size recording material. If a sheet of recording material of A4 size is passed through the fixing device, the demagnetizing coils 1 are activated by closing the demagnetizing circuits as shown in FIG. 4B, thereby preventing the end portions of the heating roller 2 from generating heat. The demagnetizing circuit including the demagnetizing coil 1 includes the demagnetizing current regulator 12 such as a resistive element or a diode element and can regulate the demagnetizing current. By activating the demagnetizing current regulator 12, it is possible to adjust the amount of the magnetic flux that induces eddy currents in the heat generating layer 21 and generates Joule heat. It is therefore possible to precisely adjust the temperature of the heat generating layer 21.

Figure 5A:
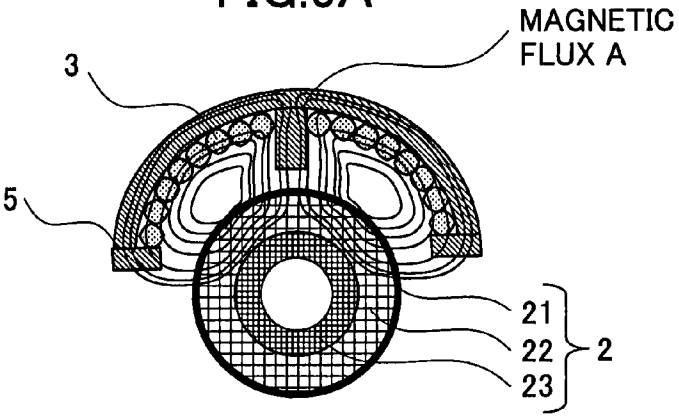
FIG. 5A is a diagram for explaining the effect of demagnetizing coils wherein no demagnetizing coil is provided.
Figure 5B:
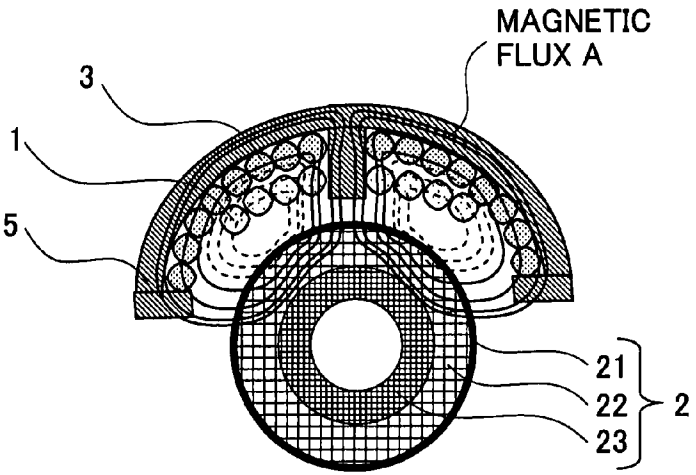
FIG. 5B is a diagram for explaining the effect of demagnetizing coils wherein the demagnetizing coils are disposed at the inner side of an exciting coil.
Figure 5C:
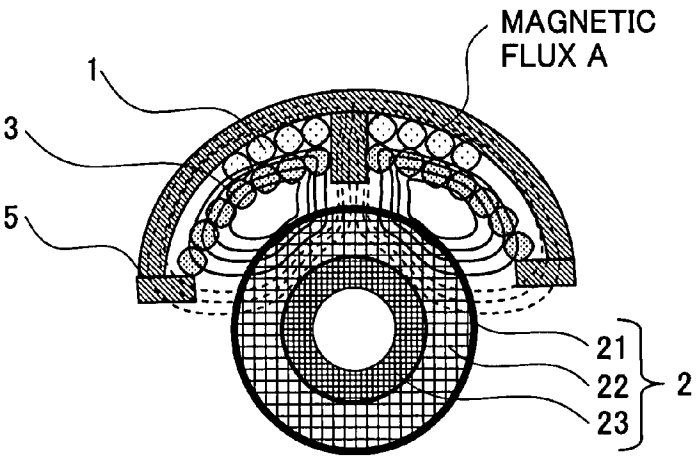
FIG. 5C is a diagram for explaining the effect of demagnetizing coils wherein the demagnetizing coils are disposed at the outer side of an exciting coil.

A further explanation is given with reference to FIGS. 5A through 5C. FIG. 5A shows magnetic flux at the cross section of the center portion of the heating roller 2 where the demagnetizing coils 1 are not disposed, wherein the exciting coil 3 is always activated. In FIG. 5A, the exciting coil 3 generates seven magnetic flux lines A, which induce eddy currents to generate Joule heat in the heat generating layer 21. On the other hand, in FIG. 5B showing the cut-away side view of the end portion of the heating roller 2, the demagnetizing coil 1 is activated to cancel three (indicated by dotted lines) of seven magnetic flux lines A generated by the exciting coil 3. Accordingly, this region of the heat generating layer 21 induces eddy currents corresponding to the three magnetic flux lines and generates Joule heat. In this case as well, it is possible to precisely adjust the temperature of the heat generating layer 21 by adjusting the magnetic flux using the demagnetizing current regulator 12 as described above.

Figure 6:
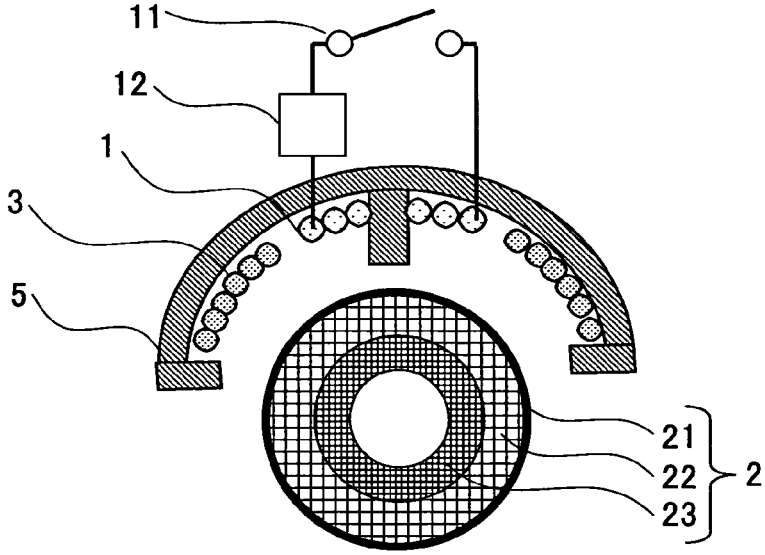
FIG. 6 is a diagram showing another arrangement of the coils.
Figure 7:
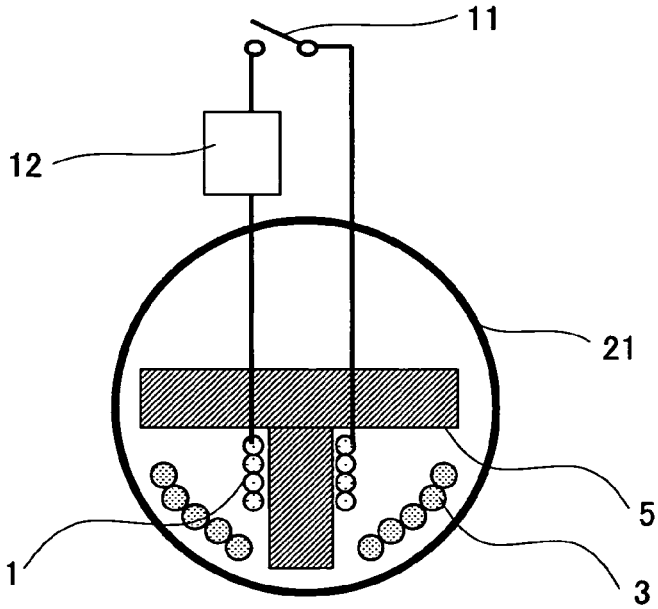
FIG. 7 is a diagram showing still another arrangement of the coils.

FIG. 5C shows an example in which the demagnetizing coils 1 are arranged differently from those shown in FIG. 5B. With this arrangement, it is possible to control heat generation as in the case of FIG. 5B. Alternatively, the exciting coil 3 and the demagnetizing coils 1 may be arranged as shown in FIG. 6 such that the exciting coil 3 and the demagnetizing coils 1 are disposed in the vicinity of the magnetic core 5 but are spaced apart from each other. Further alternatively, as shown in FIG. 7, the exciting coil 3, the demagnetizing coils 1 and the magnetic core 5, together forming the main body of the heating device, may be disposed at the inner side of the heat generating layer 21 of the heating roller 2. That is, the exciting coil 3, the demagnetizing coils 1, the magnetic core 5, together forming the main body of the heating device, and the heat generating layer 21 may be arranged such that the magnetic flux lines generated by the exciting coil 3 pass through the heat generating layer 21 such that the demagnetizing coils 1 encircle at least part of the magnetic flux lines. The magnetic core 5 may have any configuration that makes the magnetic flux lines efficiently pass through the demagnetizing coils 1 and the heat generating layer 21.

(The Demagnetizing Current Regulator 12 and the Method of Controlling the Temperature of the Heating Body)

The demagnetizing coils 1 of the heating device are controlled as described below according to an embodiment of the present invention. In this embodiment, as described with reference to FIGS. 1 and 2, the demagnetizing coils 1 are disposed to face corresponding end portions of the heating roller 2 as the non-sheet-passing region (in the case of A4 size sheets) thereof. The heating device of this embodiment can process sheets of a maximum of A3 size. When an A3 size sheet passes through the heating device, the demagnetizing coils 1 are opened so as to heat the entire region of the heating roller 2. When an A4 size sheet passes through the heating device, the demagnetizing coils 1, each facing the corresponding end portion of the heating roller 2 extending from the position on which a lateral end of the A4 size sheet passes to the corresponding end of the heating roller 2, are closed so as to reduce the heat release value in the non-sheet-passing region of the heating roller 2. In this way, by opening or closing the demagnetizing circuits including the demagnetizing coils 1 each facing the corresponding end portion of the heating roller 2 on which a small size sheet does not pass through the heating device, it is possible to appropriately control the temperature distribution in the rotational axis direction of the heating roller 2 even when sheets having different sizes pass over the heating roller 2.

The fixing device includes a temperature sensor (not shown) that detects the temperature of the heating roller 2 and can the power supply to the exciting coil 3, the opening and closing of the demagnetizing coils 1, and the amount of current according to the detected temperature. Although a thermistor may be used as the temperature sensor, a non-contact temperature sensor such as a thermopile or an infrared temperature sensor may preferably be used to prevent influence of the induction heating. It is preferable that the temperature sensor measure plural points in the rotational axis direction of the heating roller 2. It is more preferable that the temperature sensor be capable of measuring temperatures of a sheet-passing region and a non-sheet-passing region in accordance with the acceptable size of the recording material. If the demagnetizing current regulator 12 is capable of adjusting the demagnetizing current stepwise or continuously, it is possible to adjust the current values of the demagnetizing coils 1 according to the detected temperature, thereby providing more precise temperature adjustment.

Figure 8:
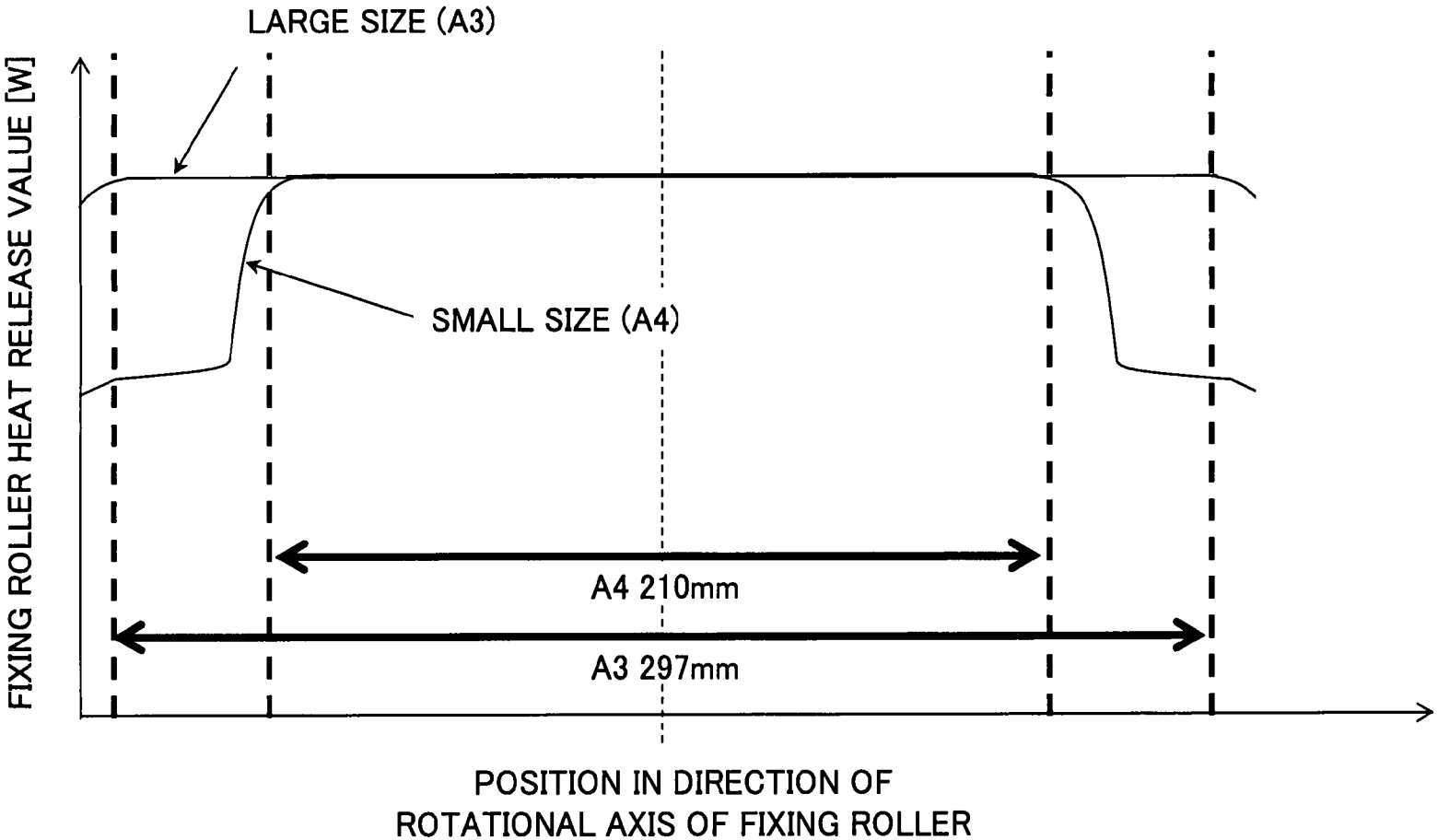
FIG. 8 is a graph showing a distribution of heat release values of a fixing roller.

FIG. 8 is a graph showing the heat release value of the heating roller 2 heated by the heating device of this embodiment. When a large size (A3 size) recording sheet is passed over, the heat release values are substantially constant across the heating roller 2 in its rotational axis direction. On the other hand, when a small size (A4 size) recording sheet is passed over, although an A4-size-sheet-passing region has substantially the same heat release value as in the case of the A3 size sheet, the end portions as non-sheet-passing regions of the heating roller 2 have the reduced heat release values. If the demagnetizing coils 1 demagnetize excessively, not only may the heat release value be further reduced, but also the demagnetizing flux may affect the A4-size-sheet-passing region and reduce the heat release value therein. To prevent such a problem, the demagnetizing current regulator 12 adjusts the generation currents of the demagnetizing coils 1 and achieves an appropriate heat release distribution.

Figure 9:
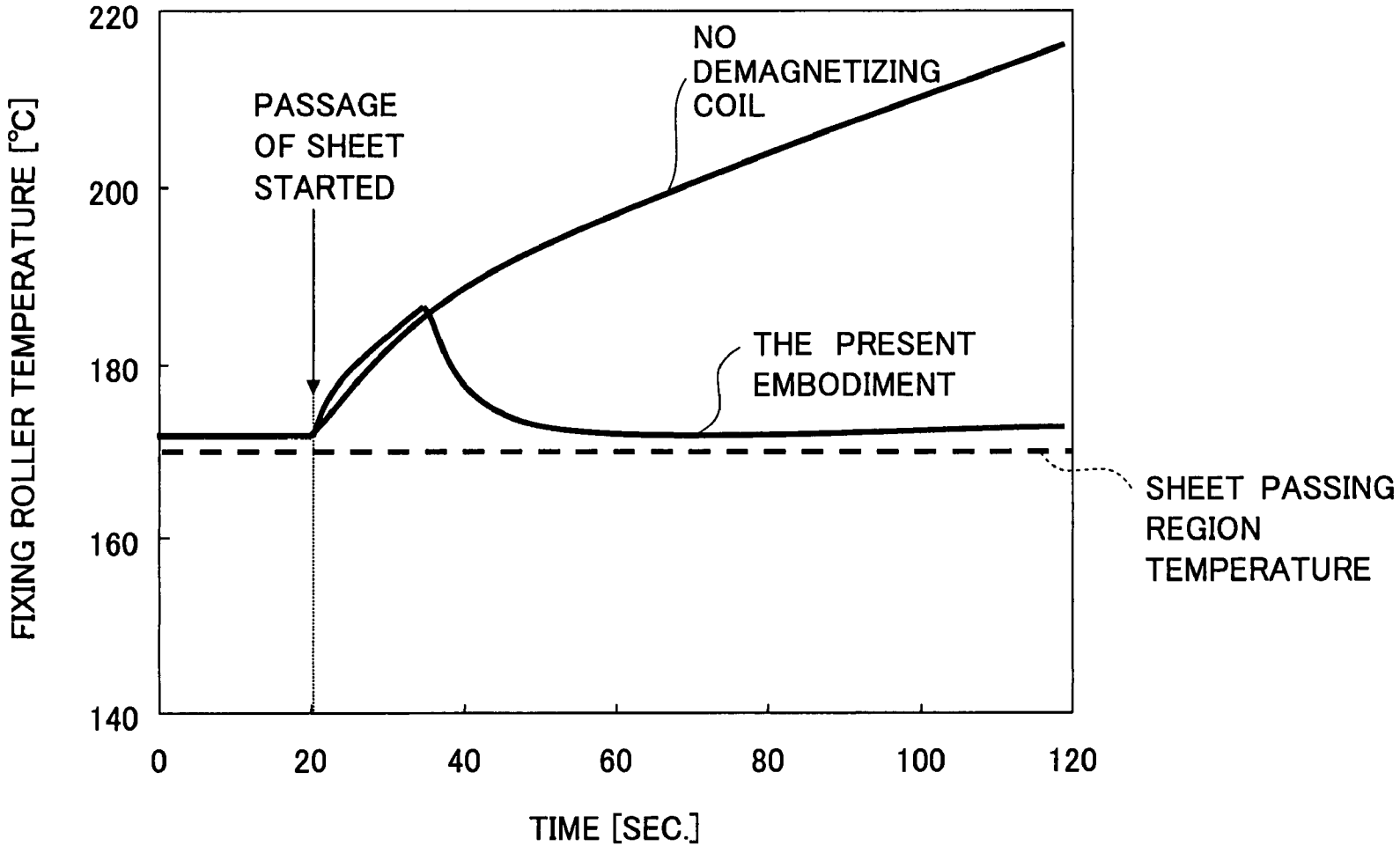
FIG. 9 is a graph showing temperature fluctuation of a fixing roller.

FIG. 9 is a graph showing temperature fluctuation on the surface of the heating roller 2 in the case where A4 size sheets are continuously passed through the fixing device of this embodiment. The dotted line shows the temperature of the substantial center of the heating roller 2, which is in the sheet-passing region. The temperature is maintained constant before and after the sheets are passed by adjusting the power supply amount to the exciting coil 3. The solid lines show temperature fluctuations in the sheet-non-passing region of the heating roller 2. The solid line labeled "without demagnetizing coil" shows the temperature of the end portion as the sheet-non-passing region in the case where the demagnetizing circuit is maintained open so as to simulate a condition where the demagnetizing coils 1 are not provided. In this case, the sheet to which heat is transferred, did not pass over, the surface temperature of the heating roller 2 increased over time, and the temperature reached approximately 220° C. 100 seconds after starting the passage of the sheets. The solid line labeled "the present embodiment" shows the temperature in the case where, when starting the passage of the sheets, the demagnetizing coils 1 are activated and the demagnetizing current regulator 12 controls the heat release value of the end portions of the heating roller. In this case, the surface temperature of the end portion of the heating roller 2 temporarily rose by 20° C. when starting the passage of the sheets. After that, however, the demagnetizing current regulator 12 was activated, so that the temperature started falling 10 seconds later. Then, 20 seconds later, the temperature was stabilized substantially at the steady state level.

In this example, the fixing device was controlled such that when the temperature of the non-sheet-passing region rose to a first preset temperature, the demagnetizing circuits including the demagnetizing coils 1 were closed to prevent heating; and when the temperature fell to a second predetermined temperature, which is lower than the first preset temperature, the demagnetizing circuits were opened to activate the demagnetizing coils 1, thereby starting heating. In this example, the second preset temperature was 170° C., and the first preset temperature was 190° C., which is higher than the first preset temperature by 20° C. When the continuous passage of the sheets started, the temperature of the sheet-passing region is controlled to maintain the preset fixing temperature of 170° C. In the case of a fixing device in which a demagnetizing coil dose not activate, the heat in the non-sheet-passing region is not transferred to the sheets, so that the temperature of the non-sheet-passing region continues to rise, eventually damaging the heating roller 2. In the case of the fixing device of the present invention, when the temperature of the end portions reached to the second preset temperature of 190° C., the demagnetizing circuits were closed to activate the demagnetizing coils 1, thereby reducing heat generation. Thus, the roller temperature was maintained uniform. In an actual image forming apparatus, it is preferable to close the demagnetizing coils 1 or/and activate the demagnetizing current regulator 12 when the temperature of the non-sheet-passing region falls below 170° C., and thus maintain the temperature at 170° C. or above. With this configuration, the non-sheet-passing region is hardly affected by the temperature of the sheet-passing region. Further, the size of sheet to be passed over can be switched to A3 at any time.

Usually, it is necessary to change the amount of heat supply to the heating roller 2 in response to changes in the operational state of the fixing device and the operating environment. Therefore, the amount of heat supply to the heating roller 2 is adjusted by changing the frequency of the electric power to be supplied to the exciting coil 3 of the heating device. However, depending on the conditions such as the frequency of the electric power to be supplied to the exciting coil 3, the current applied to the demagnetizing coils 1 may be increased too much. Thus, the temperatures of the demagnetizing coils 1 increase above the allowable temperature limit of the wires of the demagnetizing coils 1, or/and the current exceeds the allowable current of switching elements that control opening and closing of the circuits. Further, if the effect by the demagnetizing coils 1 of reducing heat generation is too great, the temperature of the non-sheet-passing regions may decrease too much. A related-art heating device of an electromagnetic induction heating system without a demagnetizing current regulator 12 frequently turns on and off the switch that controls the opening and closing of the demagnetizing circuit, thereby preventing temperature rise of the demagnetizing coil and maintaining the temperature of the non-sheet-passing regions at a predetermined level. However, frequent on/off switching of the switch of the demagnetizing circuit increases risk of mechanical failure of the switch and the risk of heating the switch. In this embodiment of the present invention, in order to solve these problems, the demagnetizing current regulator 12 is provided for the demagnetizing coil 1.

According to this embodiment of the present invention, the demagnetizing current regulator 12, including, e.g., a resistive element, a diode element, and/or a capacitor, is provided so as to adjust the demagnetizing current. Thus, without relying on frequent on/off switching of the switch of the demagnetizing circuit, it is possible to prevent the switch and the coil wires from being damaged due to a current greater than the allowable current and due to heat. Examples of the demagnetizing current regulator 12 are described with reference to first through sixth exemplary demagnetizing circuits shown in FIGS. 10 through 13, 15, and 16.

Figure 10:
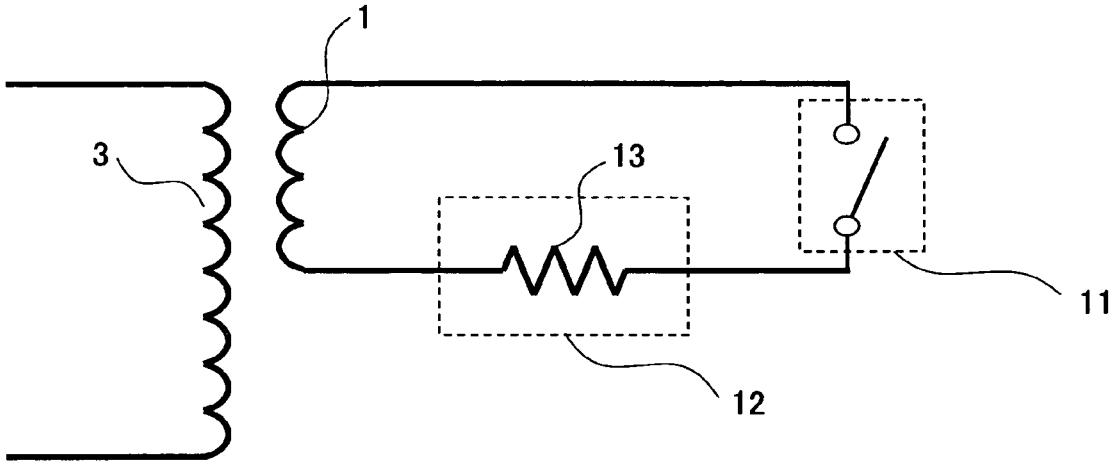
FIG. 10 is a diagram showing a first exemplary demagnetizing circuit.

FIG. 10 shows a demagnetizing circuit including a resistive element 13 as the demagnetizing current regulator 12. The above-described heating device includes the demagnetizing coil 1 having 6 turns. In this example, in the case where the demagnetizing current regulator 12 is not provided and the demagnetizing coil 1 is directly connected to the switch 11, if the demagnetizing coil 1 is activated by closing the switch 11, a current as high as about 30 A flows. Further, it was found that the effect of reducing temperature rise is sufficiently great. However, since the high current flows through the wire, the demagnetizing coil 1, and the switch 11 in the demagnetizing circuit, the entire circuit may be heated. By providing the resistive element 13 of 0.2 Ω as the demagnetizing current regulator 12, it is possible to reduce the current when the demagnetizing coil 1 is activated for reducing the temperature. It is therefore possible to prevent temperature rise of the demagnetizing coil 1 and to reduce the current that flows through the switch 11. If a variable resistance element is used as the resistive element 13, it is possible to control the current flowing through the circuit at the low level more easily compared with on/off control of the switch 11. Further, it is possible to precisely control the temperature in accordance with various sizes of sheets.

Figure 11A:
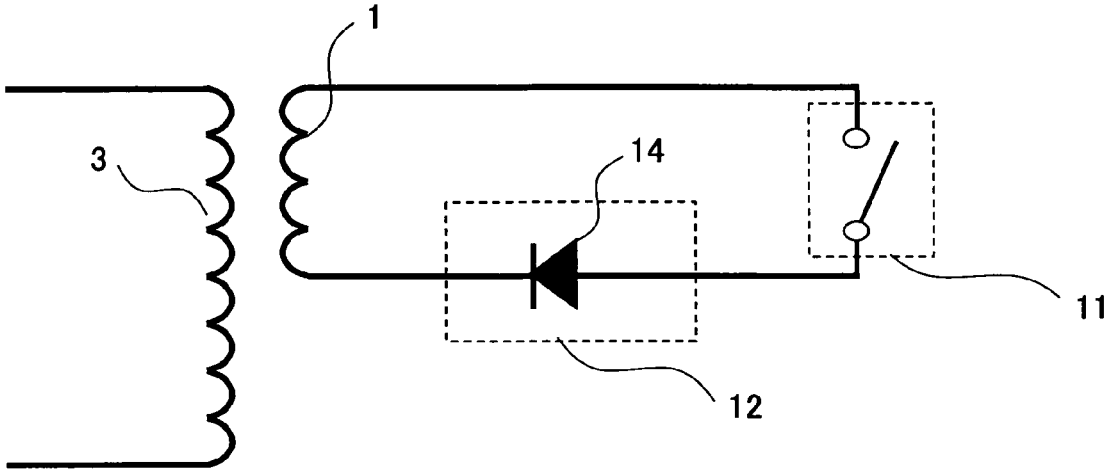
FIG. 11A is a diagram showing a second exemplary demagnetizing circuit.
Figure 11B:
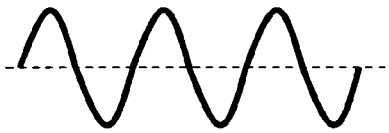
FIG. 11B is a chart showing the waveform of an exciting current.
Figure 11C:
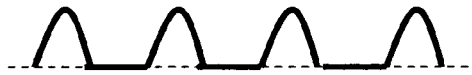
FIG. 11C is a chart showing the waveform of a demagnetizing current.
Figure 12:
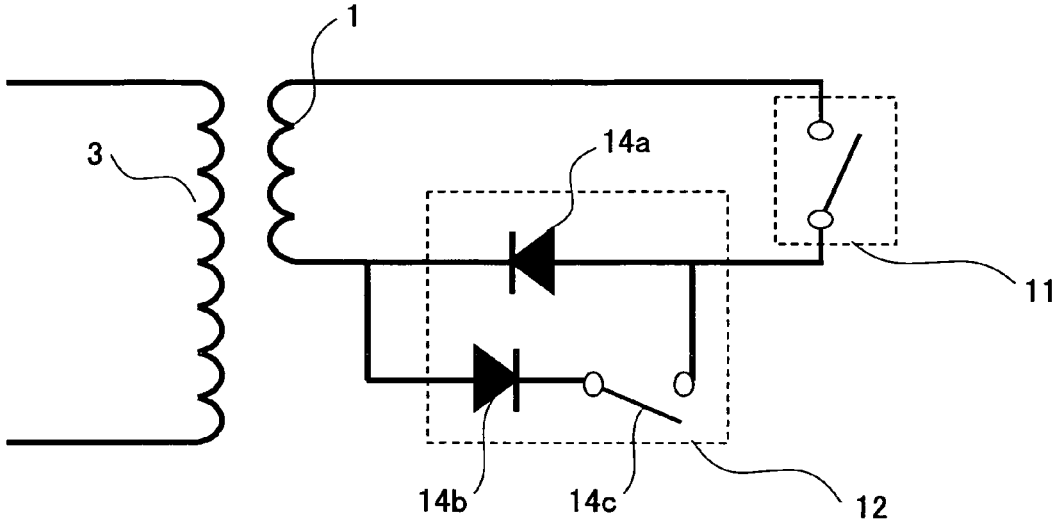
FIG. 12 is a diagram showing a third exemplary demagnetizing circuit.

FIG. 11A shows the second exemplary demagnetizing circuit including a diode element 14 as the demagnetizing current regulator 12. The diode element 14 is capable of providing half-wave rectification of the inductive current generated by the demagnetizing coil 1 due to the alternating current of the exciting coil 3. Therefore, as in the case of the resistive element 12, it is possible to adjust the effect of reducing the temperature rise in the non-sheet-passing region. FIG. 11A is a circuit diagram showing the demagnetizing circuit including the diode element 14. FIG. 11B is a chart showing the waveform of the exciting current applied to the exciting coil 3 in the demagnetizing circuit of FIG. 11A. FIG. 11C is a chart showing the waveform of the demagnetizing current generated when the demagnetizing circuit of FIG. 11A is activated. As in the third exemplary demagnetizing circuit shown in FIG. 12, the demagnetizing circuit may include a pair of diode elements 14*a*, 14*b* and a switch 14*c* so as to switch half-wave rectification and full-wave rectification depending on certain conditions. In this example, the demagnetizing current regulator 12 can convert the current value of the current flowing through the demagnetizing circuit into plural values intermittently.

Figure 13:
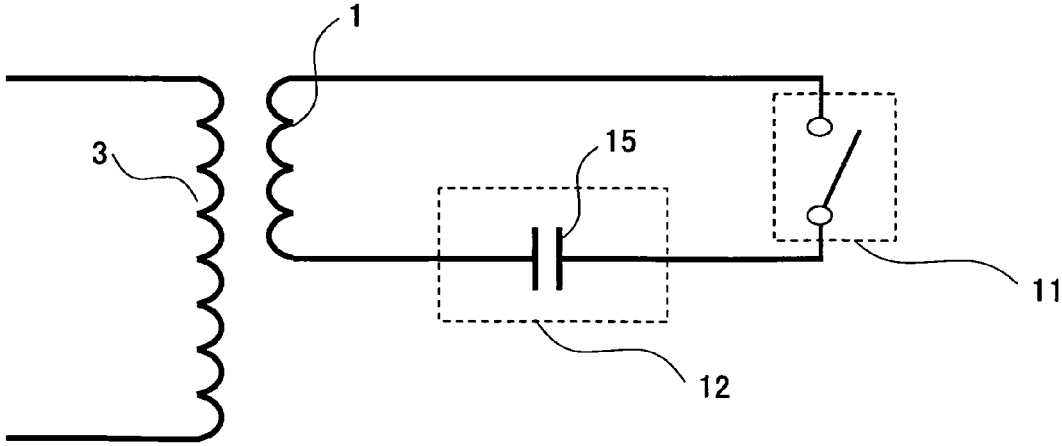
FIG. 13 is a diagram showing a fourth exemplary demagnetizing circuit.
Figure 14:
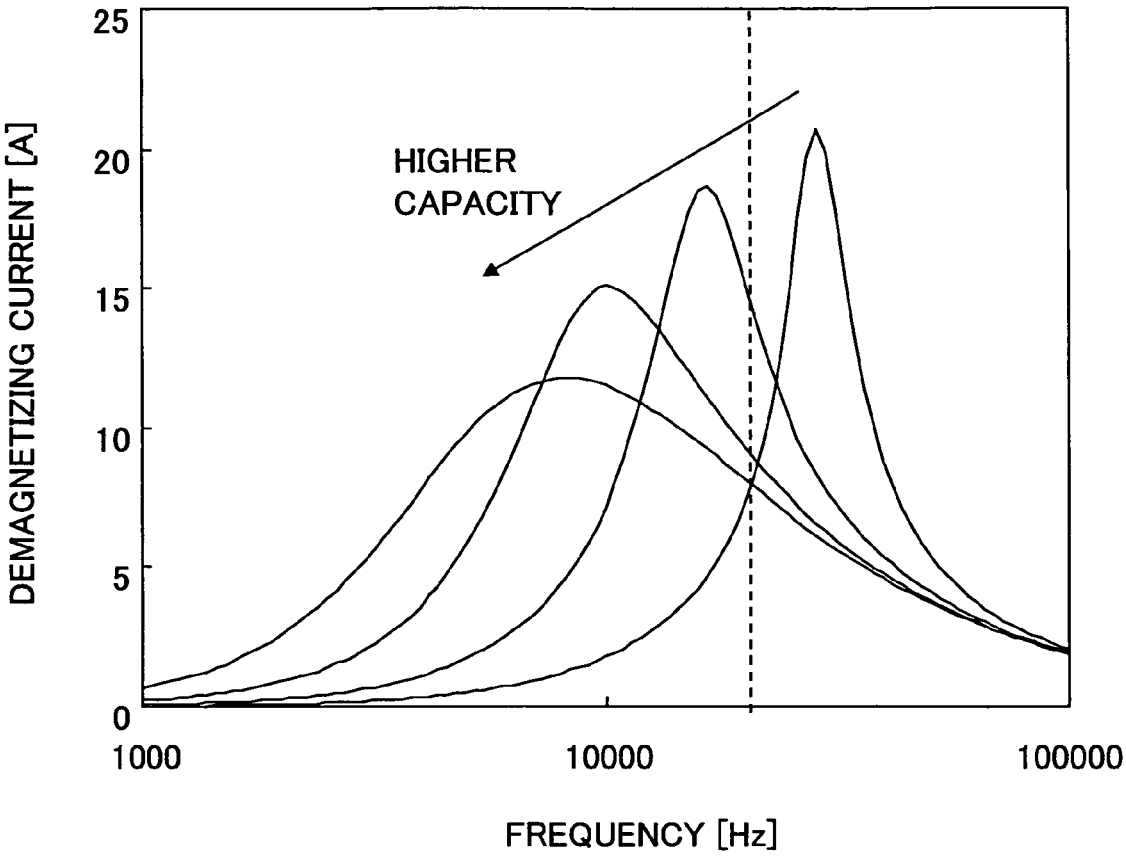
FIG. 14 is a graph showing demagnetizing currents in the fourth exemplary demagnetizing circuit.
Figure 15:
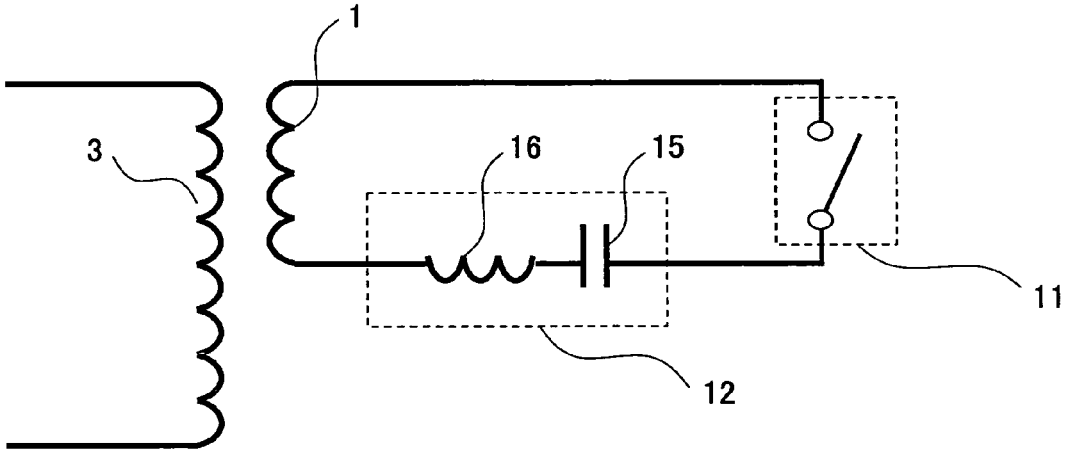
FIG. 15 is a diagram showing a fifth exemplary demagnetizing circuit.
Figure 16:
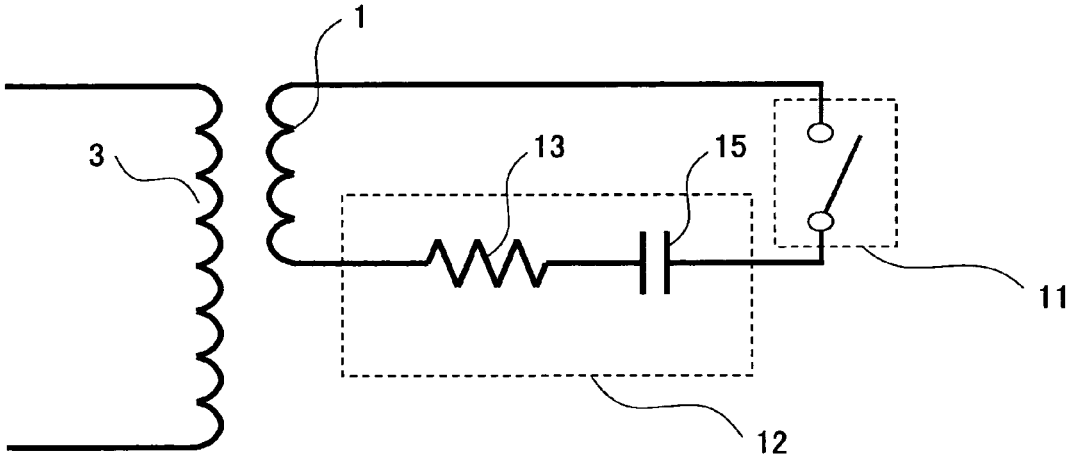
FIG. 16 is a diagram showing a sixth exemplary demagnetizing circuit.

FIG. 13 shows the fourth exemplary demagnetizing circuit including a capacitor 15 as the demagnetizing current regulator 12. FIG. 14 shows the frequency characteristics of the inductive current flowing through the demagnetizing coil 1 in the fourth exemplary demagnetizing circuit with varying capacitor capacities, 3 μF, 10 μF, 30 μF, and 100 μF. In FIG. 14, the vertical dotted line indicates a frequency of 20 kHz. When the frequency is 20 kHz, the current flowing through the demagnetizing circuit increases as the capacity of the capacitor 15 increases from 3 μF, 10 μF, 30 μF, and to 100 μF. The current value reaches its peak at a certain capacity, and eventually becomes constant.

This indicates that the provision of a capacitor having an appropriate capacity can cause LC resonance between the demagnetizing coil 1 and the capacitor. Therefore, even the arrangement of the exciting coil 3 and the demagnetizing coils 1 that allows a great leakage of magnetic flux can attain a significant effect of reducing temperature rise by applying a high current to the demagnetizing coils 1.

The fourth exemplary demagnetizing circuit shown in FIG. 13 produces LC resonance with the capacitor 15 of 5 μF capacity. However, the suitable capacity varies depending on the frequency of the current applied to the exciting coil 3 and the shapes of the exciting coil 3, the demagnetizing coils 1 and the magnetic core 5. Therefore, as in the fifth exemplary demagnetizing circuit shown in FIG. 15, the demagnetizing current regulator 12 may further include a regulator coil 16 to form an LC resonance circuit.

Figure 17:
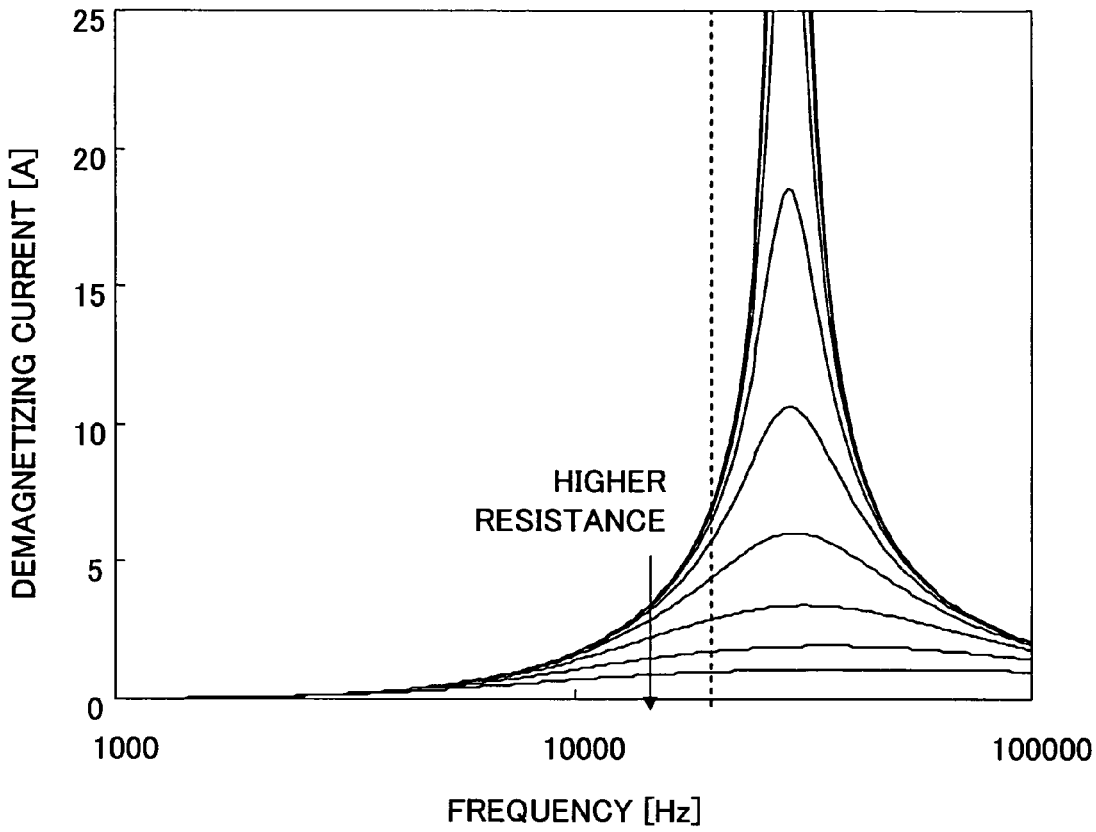
FIG. 17 is a graph showing demagnetizing currents in the sixth exemplary demagnetizing circuit.

In the case that the demagnetizing circuit produces LC resonance, the fluctuation of the exciting coil 3 largely affects the resonance characteristics. Therefore, as in the exemplary demagnetizing circuit (6) shown in FIG. 16, the demagnetizing current regulator 12 may include both a resistive element 13 and a capacitor 15, thereby lowering the peak of the demagnetizing current. This makes it possible to lower the sensitivity to the frequency fluctuation and thus enhance usability. FIG. 17 shows frequency characteristics of the demagnetizing circuit of FIG. 16 at varying resistance of a resistive element, wherein the horizontal axis represents the frequency and the vertical axis represents the inductive current of the demagnetizing coil 1. The higher the resistance, the lower the peak of the demagnetizing current becomes and the smaller the fluctuation of the demagnetizing current becomes with respect to the fluctuation of frequency of the exciting coil 3 (in the horizontal direction), resulting in higher stability.

In the demagnetizing current regulators 12 in the fourth through sixth exemplary demagnetizing circuits, the impedance of the capacitor 15, the inductance of the coil 16, and/or the resistance of the resistive element 13 may be made variable so as to adjust the current to be generated in the demagnetizing circuit according to the fluctuation of the frequency of the current applied to the exciting coil 3. In many induction heating devices, the drive frequency of the exciting coil 3 is made variable in a range about between 20 kHz-30 kHz so as to change the electric power to be supplied. Therefore, especially with the configuration that only causes the demagnetizing coil 1 to produce the effect of reducing temperature rise utilizing LC resonance in the demagnetizing current regulator 12, the fluctuation of the drive frequency of the exciting coil 3 can largely affect the effect of reducing temperature rise. On the other hand, switching or continuously changing the resistance and/or the capacity of the capacitor according to the fluctuation of the drive frequency makes it possible to maintain the appropriate effect of reducing temperature rise.

Also in the case where the inductance or impedance of the exciting coil 3 fluctuates with the fluctuation of the drive frequency of the exciting coil 3 due to temperature fluctuation of the heating roller 2 or a change in the supply power, it is possible to detect the operational state and the operating condition of the image forming apparatus and adjust the characteristics of elements, such as the capacitor, of the demagnetizing current regulator 12 to achieve desired resonance or temperature reduction according to the detected information. In this case, as in the case of FIG. 13, it is preferable that the range of variation of the resonance frequency of the demagnetizing circuit due to a change in the characteristics of the capacitor element does not overlap the frequency of the exciting circuit. This is to avoid a situation where the demagnetizing current becomes too high at the resonance frequency of the demagnetizing circuit and the exciting current of the exciting circuit becomes excessively small, resulting in being unable to provide a heating operation.

Since there is a gap between the exciting coil 3 and the demagnetizing coils 1, the leakage of magnetic flux is inevitable. To increase demagnetizing effect using a small demagnetizing coil, it is preferable to provide a magnetic core on the paths of the exciting coil and the demagnetizing coil to strengthen the connection and to provide a resonance demagnetizing circuit. Further, the resonant frequency band may be expanded by reduction of the peak current of the resonance demagnetizing circuit, and thus the fluctuation of the demagnetizing effect with respect to the frequency error of the exciting coil can be reduced.

Although the above exemplary demagnetizing circuits are described based on the premise that the demagnetizing circuits are provided one for each of the demagnetizing coils disposed at the opposing sides of the exciting coil, the opposing demagnetizing coils 1 may be electrically connected to form one demagnetizing circuit. With this configuration, in an actual fixing device, a pair of demagnetizing coils 1 are opened or closed substantially at the same timing when performing a fixing operation for a small size sheet. This configuration can reduce the number of component parts of the demagnetizing circuit and thus can reduce the size and cost of the heating device.

Although the demagnetizing coils 1 are provided one at each side, the demagnetizing coils 1 may be provided two or more at each side. Provision of demagnetizing circuits two or more at each side allows more precise temperature adjustment of the heating roller 2.

(Fixing Device)

As shown in FIG. 1, the fixing device of this embodiment of the present invention including the above-described heating device has a configuration similar to the related-art heating device of an electromagnetic induction heating system. However, the fixing device of this embodiment includes the demagnetizing current regulator 12 as shown in FIG. 3 in the demagnetizing circuit. This configuration makes it possible to reduce the sizes of the demagnetizing coils, make the fixing device compact, increase the heat utilization rate, facilitate heating temperature control, and appropriately perform a fixing operation even when different size sheets are continuously passed therethrough. The heating roller 2 is an example of a heating member in the fixing device, and any other suitable heating members may alternatively be used. For instance, in the case of a fixing device including a heating belt, the heating belt may be heated as a heating member by electromagnetic induction heating as in the case of the heating roller 2. Further, a heating member of an embodiment of the present invention may be used in place of a ceramic heater for heating the heating belt.

(Image Forming Apparatus)

Figure 18:
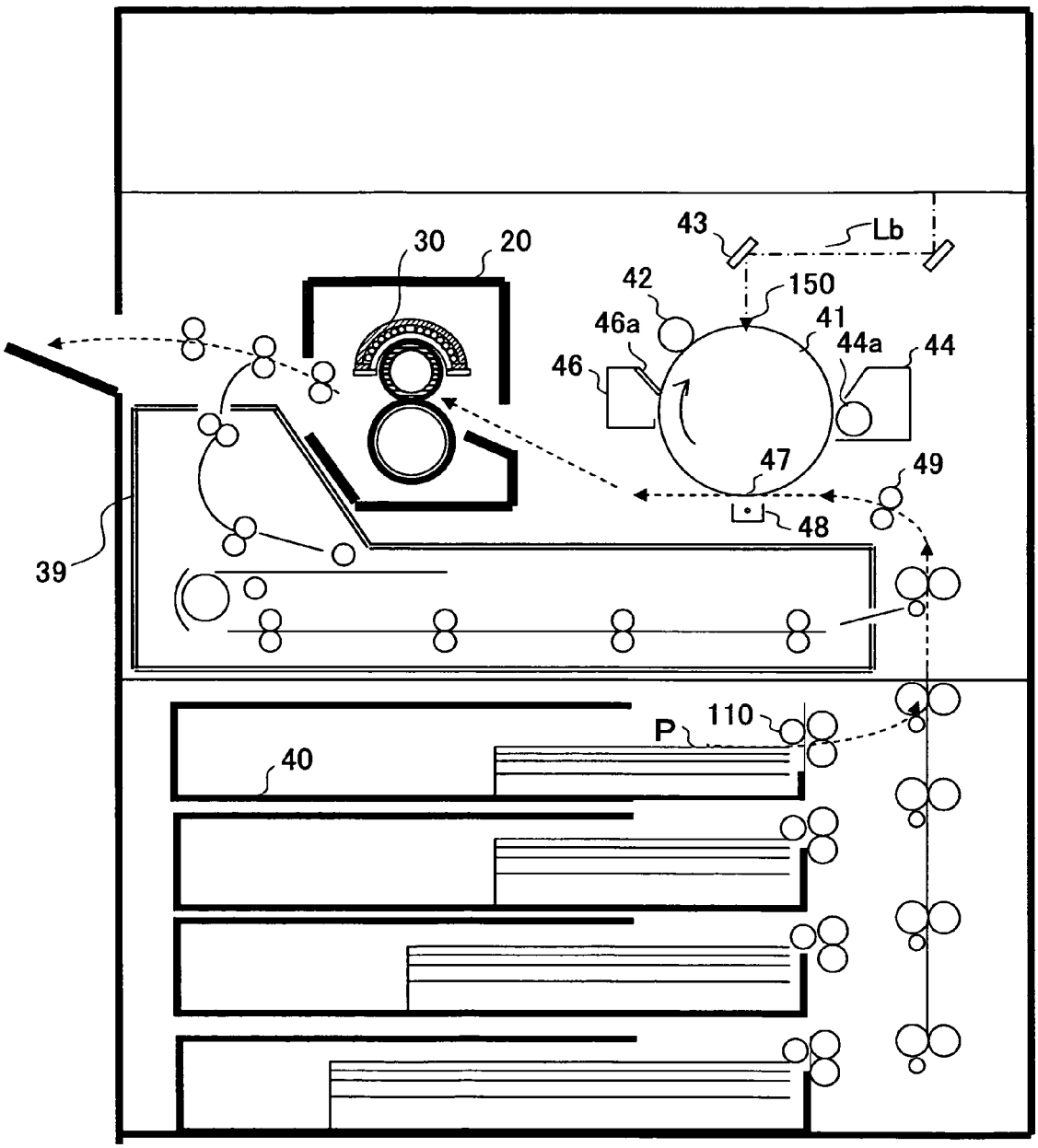
FIG. 18 is a schematic configuration diagram of an image forming apparatus according to an embodiment of the present invention.

FIG. 18 is a cut-away side view of an image forming apparatus according to an embodiment of the present invention. The image forming apparatus includes an upper portion and a lower portion that together form the entire image forming apparatus. The upper portion includes a document scanning unit (not shown) and an image forming unit thereunder. The lower portion includes a sheet feed tray 40 in which recording materials P are placed. The image forming unit includes a drum-shaped photoreceptor 41, which is an example of an image carrier. In the vicinity of the photoreceptor 41, there are provided a charging unit 42; a mirror 43 of an exposure unit; a development unit 44; a transfer unit 48 that transfers the developed image onto a transfer sheet as the recording material P in a transfer portion 47; a cleaning unit 46 including a blade that slidably contacts the peripheral surface of the photoreceptor 41; etc., in this order in the direction of the arrow shown in the photoreceptor 41 of FIG. 18. An exposure laser beam Lb reflected by the mirror 43 scans the photoreceptor 41 between the charging unit 42 and the development unit 44. A pair of resist rollers 49 are disposed upstream the transfer portion 47 in the sheet feed path. The recording material P in the sheet feed tray 40 is transported toward the pair of resist rollers 49 by being guided by a transport guide. A fixing device 20 of an embodiment of the present invention is disposed downstream of the transfer portion 47. The fixing device 20 includes a heating device 30 of an embodiment of the present invention. After having a toner image fixed by the fixing device 20, the recording material P is discharged onto a discharge tray.

This image forming apparatus forms an image as described below. The photoreceptor 41 starts rotating. The charging unit 42 uniformly charges the rotating photoreceptor 41 in the dark. The exposure laser beam Lb is directed onto and scans an exposure portion 150, so that a latent image is formed that corresponds to an image to be formed. The latent image is transported to the development unit 44 with the rotation of the photoreceptor 41, in which development unit 44 the latent image is developed with toner to become a toner image. Meanwhile, the recording material P in the sheet feed tray is transported to the pair of resist rollers through the sheet feed path indicated by the dotted line and stops to wait for the timing to be transported such that the toner image on the photoreceptor 41 is transferred to the recording material P in the transfer portion 47. The recording material P is transported from the pair of resist rollers 49 toward the transfer portion 47 in synchronization with the rotation of the photoreceptor 41. The toner image on the photoreceptor 41 is transferred onto the recording material P due to the electric field of the transfer unit 48 in the transfer portion 47. The recording material P with the toner image transferred thereon is transported toward the fixing device 20. Then, the recording material P is passed through the fixing device, so that the toner image is fixed on the recording material P. The recording material P is then discharged onto a discharge tray. This image forming apparatus includes an automatic two-side printing unit 39 that switches back the recording material P discharged therein. The recording material P is transported again to the pair of resist rollers 49, and then an image is formed on the other side of the recording material P. Residual toner remaining on the photoreceptor 41 without being transferred in the transfer portion 47 reaches the cleaning unit 46 through the rotation of the photoreceptor 41. The residual toner is removed while passing through the cleaning unit 46, so that the photoreceptor 41 becomes ready for the next image formation.

The present application is based on Japanese Priority Application No. 2007-021954 filed on Jan. 31, 2007, with the Japanese Patent Office, the entire contents of which are hereby incorporated by reference.

What is claimed is:

1. A heating device that heats, by electromagnetic induction heating, a heating member disposed in a fixing device for use in an image forming apparatus, which fixing device heats and fixes an image on a recording material while nipping and transporting the recording material, the heating device comprising:

an exciting coil that is disposed along the heating member and generates an alternating magnetic flux to heat the heating member by the electromagnetic induction heating;

a demagnetizing coil that encircles part of the alternating magnetic flux generated by the exciting coil and generates an electro motive force in a direction that cancels the alternating magnetic flux;

a switching member for forming a closed circuit in which a demagnetizing current generated by the electro motive force of the demagnetizing coil flows; and a demagnetizing current regulator provided in the closed circuit in which the demagnetizing current flows for adjusting the demagnetizing current, wherein the demagnetizing regulator includes a capacitor for causing LC resonance between the demagnetizing coil and the capacitor so that the demagnetizing current is increased due to the LC resonance between the demagnetizing coil and the capacitor, wherein the heating device is configured to detect a drive frequency of the exciting coil, and when the detected drive frequency changes, a resonance frequency of the LC resonance between the demagnetizing coil and the capacitor is changed by changing a capacity of the capacitor, wherein a range of variation of the resonance frequency of the LC resonance between the demagnetizing coil and the capacitor does not overlap a frequency of an exciting circuit so that the range of variation of the resonance frequency is higher or lower than a resonance frequency of the exciting coil.

2. The heating device as claimed in claim 1, wherein the demagnetizing current regulator includes a resistive element.

3. The heating device as claimed in claim 1, wherein the demagnetizing current regulator includes a diode element.

4. The heating device as claimed in claim 1, wherein the demagnetizing current regulator further includes a coil.

5. The heating device as claimed in claim 1, wherein the closed circuit forms a resonance circuit.

6. A fixing device adapted for use in an image forming apparatus and configured to heat and fix an image on a recording material while nipping and transporting the recording material with use of a heating member and a pressure member, the fixing device comprising:

the heating device of claim 1 that heats the heating member by electromagnetic induction heating.

7. The fixing device as claimed in claim 6, wherein the heating member includes a heating roller.

8. The fixing device as claimed in claim 6, wherein the heating member includes a heating belt.

9. An image forming apparatus capable of forming images on recording materials of different widths, the image forming apparatus comprising:

the fixing device of claim 6.

10. A method of controlling a temperature of a heating member that is to be heated by an electromagnetic induction heating system and is disposed in a fixing device for use in an image forming apparatus, which fixing device heats and fixes an image on a recording material while nipping and transporting the recording material, wherein an exciting coil disposed along the heating member generates an alternating magnetic flux to heat the heating member by the electromagnetic induction heating, and wherein a demagnetizing circuit including a demagnetizing coil, which encircles part of the alternating magnetic flux generated by the exciting coil, generates an electro motive force in a direction that cancels the alternating magnetic flux, the method comprising:

providing a switching member for forming a closed circuit in which a demagnetizing current generated by the electro motive force of the demagnetizing coil flows;

adjusting the demagnetizing current by using a demagnetizing current regulator, provided in the closed circuit, when the closed circuit generates the electro motive force, wherein the demagnetizing regulator includes a capacitor for causing LC resonance between the demagnetizing coil and the capacitor so that the demagnetizing current is increased due to the LC resonance between the demagnetizing coil and the capacitor;

configuring the electromagnetic induction heating system to detect a drive frequency of the exciting coil; and adjusting a capacity of the capacitor to change a resonance frequency of the LC resonance between the demagnetizing coil and the capacitor when the detected drive frequency of the exciting coil changes, wherein a range of variation of the resonance frequency of the LC resonance between the demagnetizing coil and the capacitor does not overlap a frequency of an exciting circuit so that the range of variation of the resonance frequency is higher or lower than a resonance frequency of the exciting coil.

11. The method of controlling the temperature of the heating member as claimed in claim 10, wherein the demagnetizing current regulator includes at least one of a resistive element and a diode element.

12. The method of controlling the temperature of the heating member as claimed in claim 10, wherein the demagnetizing current regulator includes a coil and adjusts at least one of an impedance of the capacitor or an inductance of the coil to form a resonance circuit.

* * * * *